US012768156B1

(12) United States Patent
Rios

(10) Patent No.: US 12,768,156 B1
(45) Date of Patent: Oct. 20, 2026

(54) ODOR REMOVAL DEVICE

(71) Applicant: Luis Rios, Safford, AZ (US)

(72) Inventor: Luis Rios, Safford, AZ (US)

( * ) Notice: Subject to any disclaimer, the term of this patent is extended or adjusted under 35 U.S.C. 154(b) by 107 days.

(21) Appl. No.: 18/816,048

(22) Filed: Aug. 27, 2024

(51) Int. Cl.
*E03D 9/052* (2006.01)
*A47K 13/30* (2006.01)

(52) U.S. Cl.
CPC ..... *E03D 9/052* (2013.01); *A47K 13/307* (2013.01)

(58) Field of Classification Search
CPC .. E03D 9/04; E03D 9/05; E03D 9/052; A47K 13/307; F24F 7/02; F24F 7/025
USPC ..... 4/213, 214, 217, 218, 209 FF
See application file for complete search history.

(56) References Cited

U.S. PATENT DOCUMENTS 2,172,506 A * 9/1939 Gerger ..... E03D 9/052 4/217
4,071,915 A * 2/1978 Kuratarо ..... E03D 9/052 4/DIG. 6
4,984,310 A * 1/1991 Casale ..... E03D 9/05 4/213
6,260,215 B1 7/2001 Miller
6,449,778 B1 9/2002 Franco
6,496,986 B1 12/2002 Lumsden
6,772,449 B1 * 8/2004 Wolfe ..... E03D 9/05 4/213
7,337,476 B2 3/2008 Green
7,730,560 B2 6/2010 Markaj
D653,318 S 1/2012 Torner et al.
8,973,174 B2 3/2015 Palazzola
9,422,703 B1 8/2016 Ciotic
9,756,996 B1 9/2017 Ruiz
11,166,606 B1 11/2021 Suiter
2003/0070212 A1 4/2003 Brodhead
2013/0283512 A1 * 10/2013 Florexil ..... E03D 9/052 4/217

FOREIGN PATENT DOCUMENTS

CH 610613 A5 * 4/1979 ..... E03D 9/052
WO 2018091858 A1 5/2018

* cited by examiner

*Primary Examiner* — Tuan N Nguyen
(74) *Attorney, Agent, or Firm* — Cramer Patent & Design, PLLC.; Aaron R. Cramer

(57) ABSTRACT

An odor removal device for toilets removes malodorous air from the toilet bowl to maintain a fresh ambient environment. The device comprises a hollow seat surface with multiple suction ports covered by protective screens, connected via a flexible tube to a standpipe. A vacuum pump connected to the standpipe generates negative pressure, drawing malodorous air through the system. The air is expelled outside the building via a vent stack. Activation is controlled by a pressure-activated switch located under the seat surface, powered by a power source.

2 Claims, 3 Drawing Sheets

ODOR REMOVAL DEVICE

RELATED APPLICATIONS

Non-Applicable.

FIELD OF THE INVENTION

The present invention relates generally to odor removal systems for toilets. More specifically, it pertains to a device designed to efficiently remove malodorous air directly from the toilet bowl, improving the ambient air quality in restrooms by integrating a vacuum pump system and venting mechanism within the toilet seat assembly.

BACKGROUND OF THE INVENTION

Traditional toilets often allow malodorous air to escape into the surrounding environment, causing discomfort and potential embarrassment for users. Existing solutions such as air fresheners or external ventilation systems do not address the problem at its source and can be ineffective or impractical. The need for a more efficient, integrated solution led to the development of the present invention. By incorporating a vacuum pump system and strategically placed suction ports within the toilet seat itself, this invention offers a direct and effective method for removing unpleasant odors from the toilet bowl, ensuring a more pleasant and hygienic restroom experience.

SUMMARY OF THE INVENTION

Embodiments of the present disclosure may include an odor removal device for a toilet, featuring a hollow seat surface configured to replace a conventional toilet seat and be mechanically coupled to the toilet via hinges. The device may also include multiple suction ports positioned on the seat surface to draw in malodorous air from the toilet bowl.

A flexible tube may be connected to the hollow seat surface to transport the malodorous air from the suction ports. Additionally, a standpipe in mechanical communication with the flexible tube is configured to route the malodorous air. A vacuum pump connected to the standpipe creates a negative pressure to draw the malodorous air through the suction ports and flexible tube.

A vent stack connected to the vacuum pump exhausts the malodorous air outside a building envelope. A pressure-activated switch located under the seat surface activates the vacuum pump when a user sits on the seat surface. Protective screens cover the suction ports to prevent the entry of solids and liquids. The device also includes a power source connected to the vacuum pump through wiring to supply electrical power.

In some embodiments, the hollow seat surface includes multiple suction ports positioned on opposite sides of the seat surface. The flexible tube allows the seat surface to be raised or lowered in a conventional manner without disrupting the airflow. The standpipe may be configured to be routed either externally or within a wall cavity near the toilet.

The vacuum pump may be positioned at the top end of the standpipe, placing the standpipe, flexible tube, and seat surface under negative pressure during operation. The vent stack may be configured to pass through a building envelope, such as a roof or wall, to expel malodorous air outside the building. The pressure-activated switch may close when a user sits on the seat surface, thereby activating the vacuum pump.

Protective screens may prevent the entrance of solid and liquid wastes into the suction ports. The power source may be an AC power supply or a battery and may be connected to the vacuum pump motor via electrical wiring. The odor removal device may include a timer mechanism to allow the vacuum pump to continue operating for a predetermined time after the user gets off the seat surface.

The hollow cavity within the seat surface may be continuous throughout its circumference to allow even airflow and removal of malodorous air. The vacuum pump motor may be an integral component of the vacuum pump, and the wiring configuration allows for a series connection between the power source, switch, and vacuum pump motor.

The seat surface may be designed to be compatible with various types of toilets, including one-piece, two-piece, wall-mounted, floor-mounted, and tankless designs. The device may be configured for easy installation and use, requiring minimal training for the user. A shroud covering each suction port and protective screen may further prevent contamination from solids and liquids.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | odor removal device |
| 15 | toilet |
| 20 | hinge |
| 25 | seat surface |
| 30 | suction port |
| 35 | flexible tube |
| 40 | standpipe |
| 45 | vacuum pump |
| 50 | vent stack |
| 55 | building envelope |
| 60 | switch |
| 65 | screen |
| 70 | malodorous air |
| 75 | hollow cavity |
| 80 | shroud |
| 85 | power source |
| 90 | wiring |
| 95 | vacuum pump motor |

DESCRIPTION OF THE PREFERRED EMBODIMENTS

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 1:
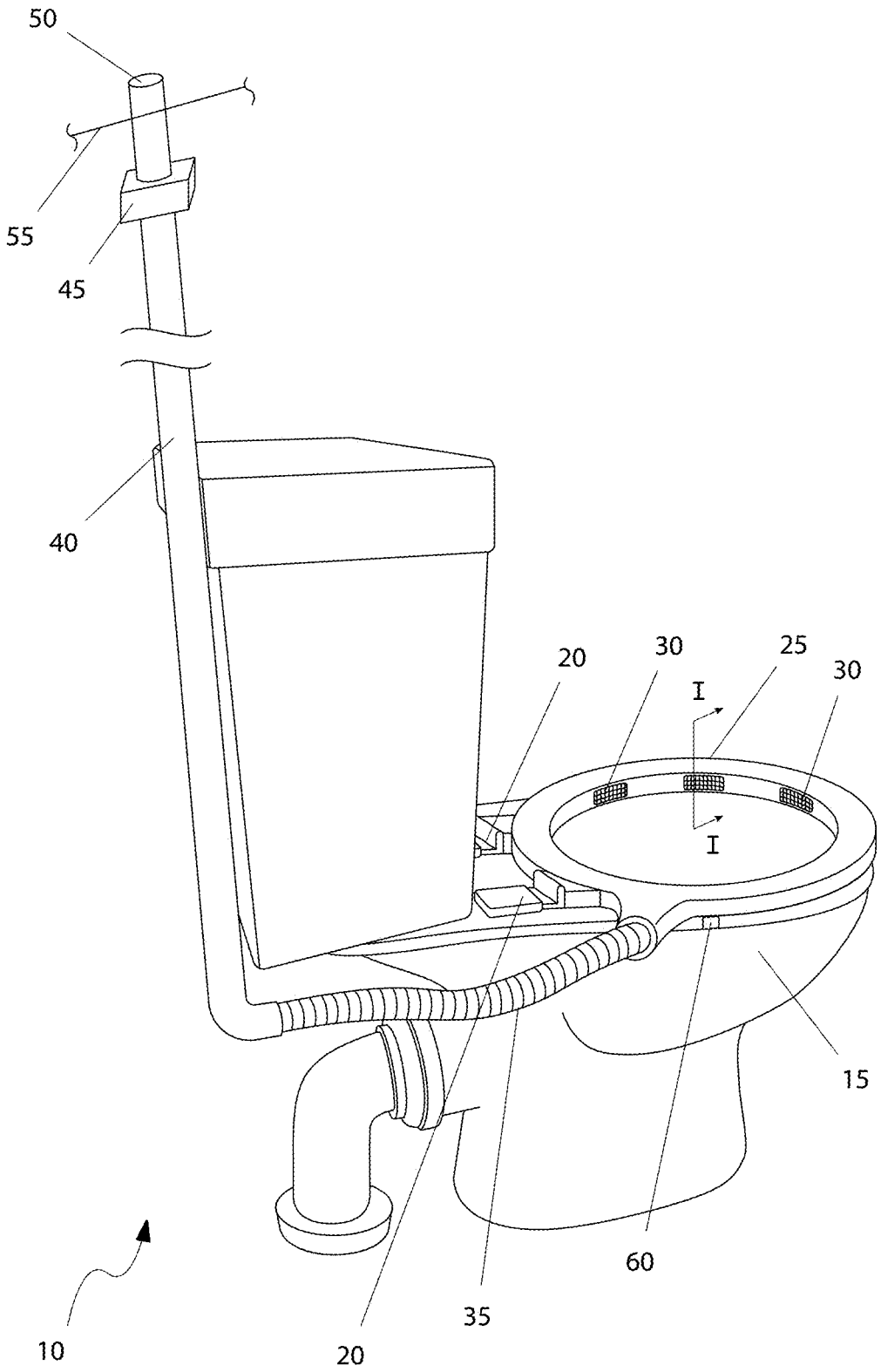
FIG. 1 is a side elevation view of the odor removal device 10 for a toilet 15, installed on a toilet 15, according to the preferred embodiment of the present invention.

Referring now to FIG. 1, a side elevation view of an odor removal device 10 for a toilet 15, according to the preferred embodiment of the present invention is disclosed. The odor removal device (herein also described as the "device") 10, is designed to remove malodorous air 70 directly from a bowl of the toilet 15. The device 10 is configured to be installed directly upon a toilet 15 in place of the conventional toilet seat, and may or may not include a lid (not shown for purposes of clarity. The toilet 15 depicted is for illustrative purposes only, and is of conventional design and may take the form of one-piece, two-piece, wall-mounted, floor-mounted, tankless or similar designs. The use of the device 10 upon any specific size or type of toilet 15 is not intended to be a limiting factor of the present invention.

The device 10 is mechanically coupled to the toilet 15 through the utilization of two (2) hinges 20. The hinges 20 connect in a conventional manner. The device 10 utilizes a seat surface 25 that is hollow in nature and includes multiple suction ports 30. A nominal quantity of three (3) on the right side (shown) and three (3) on the left side (not shown due to illustrative limitations) are provided. No suction ports 30 on the front or rear of the seat surface 25 are envisioned as to reduce possible soiling from solid or liquid wastes. Further detail on the suction ports 30 will be provided herein below. The interior hollow space is in communication with a flexible tube 35. The flexible nature of the flexible tube 35 allows for the seat surface 25 to be raised or lowered (as shown) in a conventional manner. The opposite end of the flexible tube 35 is in mechanical communication with a vertical standpipe 40. The standpipe 40 may be exposed or hidden within a wall cavity near the toilet 15. The top end of the standpipe 40 is provided with a vacuum pump 45 which places the standpipe 40, the flexible tube 35, and the seat surface 25 under a negative pressure when in operation. Details on operation of the vacuum pump 45 will be provided herein below. The pressurized side of the vacuum pump 45 is connected to a section of vent stack 50 which exits a building envelope 55 such as a roof, wall, or the like. A pressure-activated switch 60 is located under the seat surface 25 and is closed when a user sits upon the seat surface 25.

Figure 2:
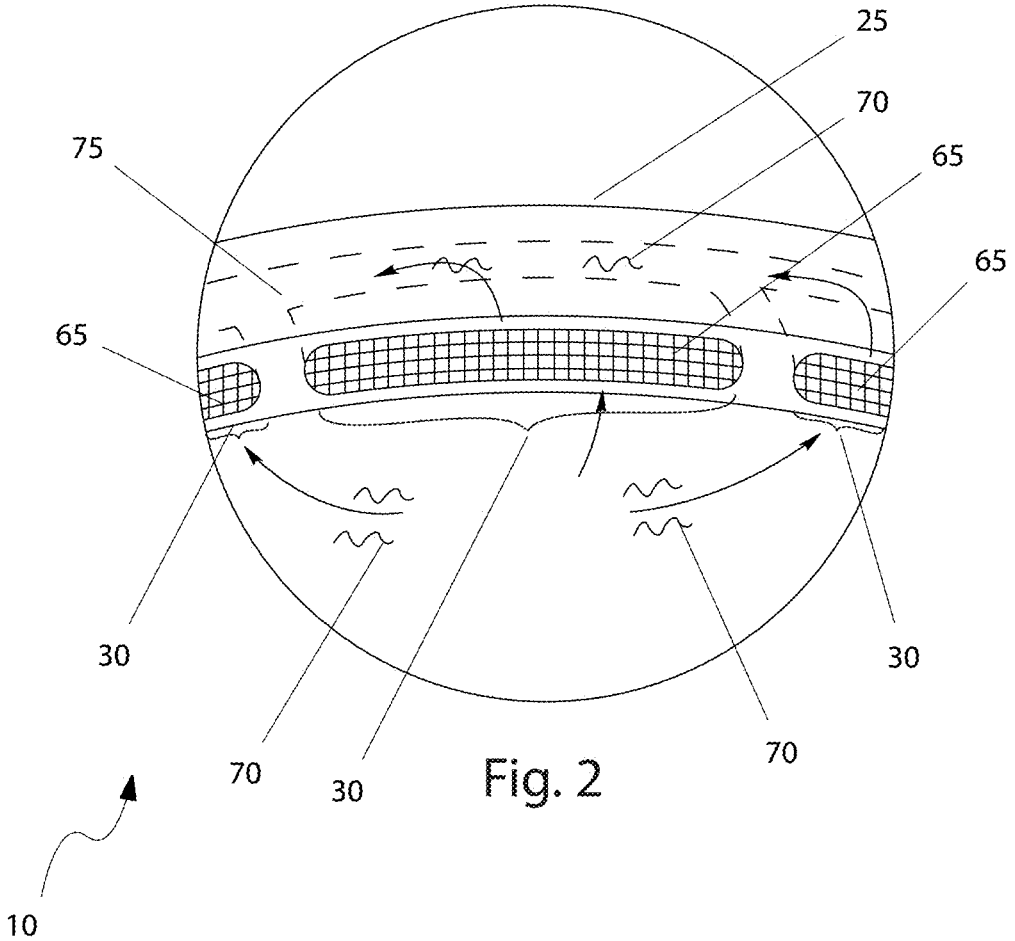
FIG. 2 is a detailed view of the odor removal device 10, according to the preferred embodiment of the present invention.

Referring next to FIG. 2, a detailed view of the device 10, according to the preferred embodiment of the present invention is depicted. This view discloses the three (3) suction ports 30 in the seat surface 25 (one (1) fully shown and two (2) partially shown). Each of the suction ports 30 is provided with a protective screen 65 to prevent the entrance of solids such as feces, and to reduce the entrance of liquids such as urine. During use of the device 10, any malodorous air 70 produced during the act of defecation, is pulled into all of the suction ports 30 via the vacuum force generated by the vacuum pump 45 (as shown in FIG. 1). After entering through the suction ports 30, the malodorous air 70 enters the hollow cavity 75 of the seat surface 25, where it is drawn into the flexible tube 35 (as shown in FIG. 1). It is envisioned that the hollow cavity 75 is continuous throughout the entire circumference of the seat surface 25 to allow for even flow and removal of the malodorous air 70 via a low speed, high volume process, without excessive pressure differential, noise, or the like.

Figure 3:
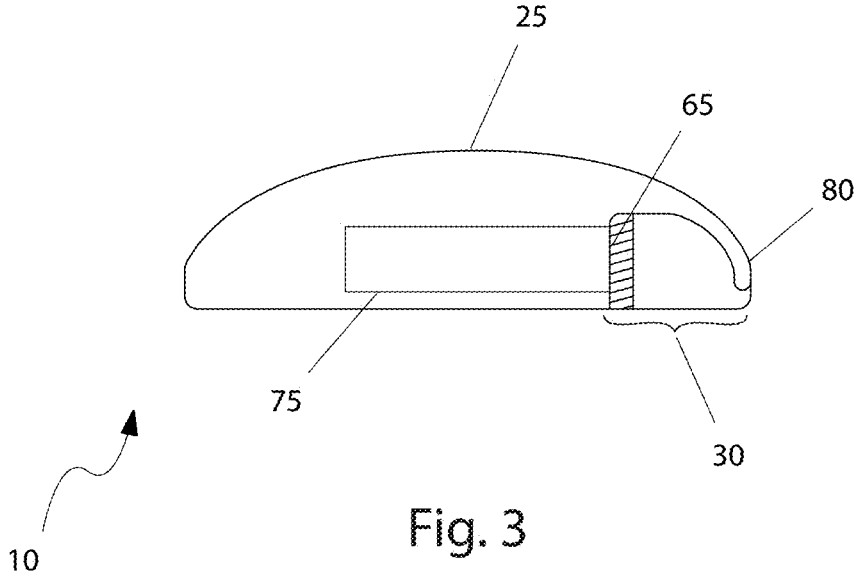
FIG. 3 is a sectional view of the odor removal device 10, as seen along a line I-I, as shown in FIG. 1, according to the preferred embodiment of the present invention; and, FIG. 4 is an electrical block diagram of the odor removal device 10, according to the preferred embodiment of the present invention.

Referring now to FIG. 3, a sectional view of the device 10, as seen along a line I-I, as shown in FIG. 1, according to the preferred embodiment of the present invention is shown. This view exposes one (1) of the suction ports 30, which is typical in appearance for all six (6). The hollow cavity 75 as well as the screen 65 is visible. In an effort to further reduce entrance and contamination of the suction ports 30 and the screen 65 from solids (feces) or liquids (urine), each suction port 30 is provided with a protective shroud 80 which covers each suction port 30 and screen 65.

Figure 4:
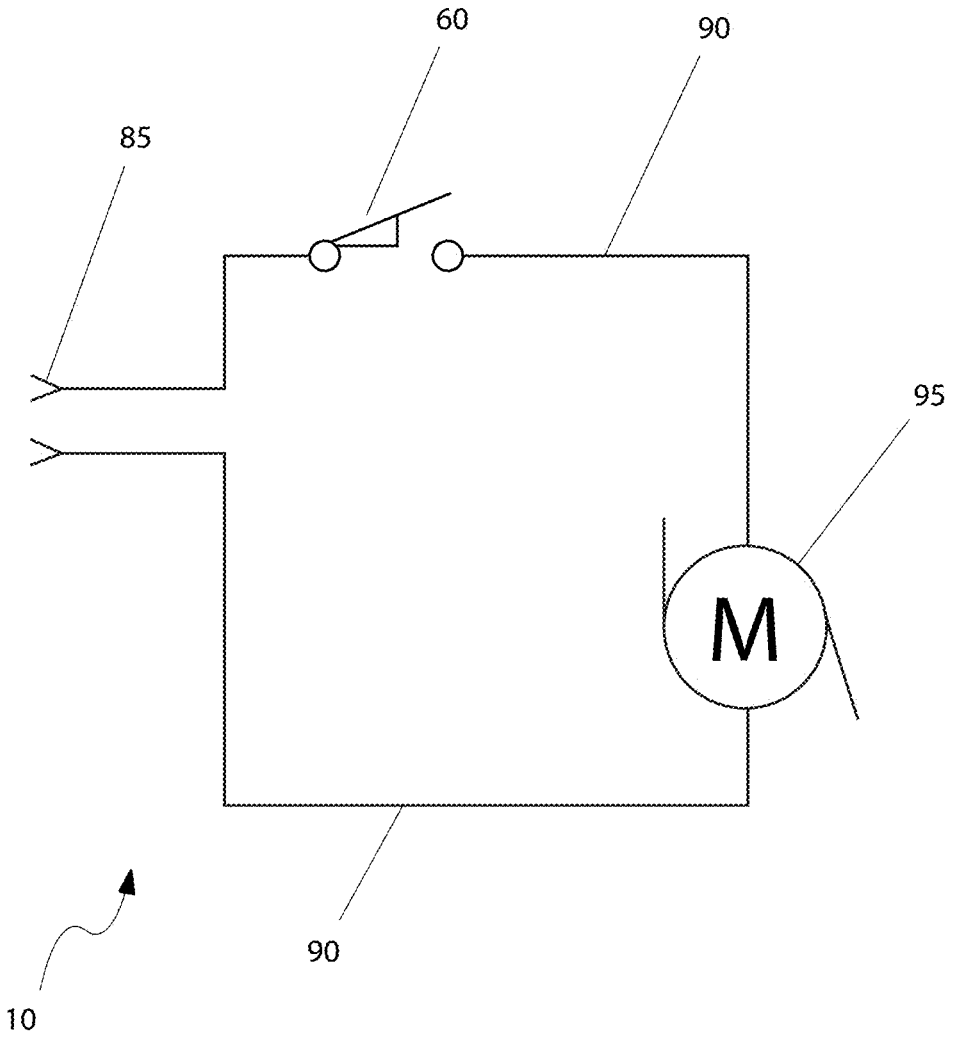

Referring finally to FIG. 4, an electrical block diagram of the odor removal device for toilets 10, according to the preferred embodiment of the present invention is disclosed. The device 10 is powered electrical power from a power source 85, envisioned to be AC power or battery power. The use of any particular type of power source 85 is not intended to be a limiting factor of the present invention. Electrical power then passes in a series configuration via wiring 90 through the pressure activated switch 60 and a vacuum pump motor 95, provided as an integral component of the vacuum pump 45. In such a manner, whenever a user sits upon the seat surface 25 (as shown in FIG. 1), the switch 60 is activated, thus allowing the device 10 to operate as described above. It is also envisioned that the switch 60 could be replaced or complimented by a timer mechanism, which would allow for initial operation of the vacuum pump motor 95 upon a user sitting upon the seat surface 25 and allows for continued operation of the vacuum pump motor 95 for a predetermined time after the user getting off of the seat surface 25 to allow for continued operation and odor removal during final stages of defecation and flushing of the toilet 15 (as shown in FIG. 1).

A specific embodiment of the odor removal device 10 for a toilet 15 is designed to efficiently remove malodorous air 70 directly from the toilet bowl. This device 10, consists of all the numbered elements and is installed in place of the conventional toilet seat, is mechanically coupled to the toilet 15 via two hinges 20, allowing the hollow seat surface 25, which contains multiple suction ports 30, to be raised or lowered. These suction ports 30, located on the seat surface 25, draw malodorous air 70 into the device. The malodorous air 70 is then transported through a flexible tube 35, which provides necessary flexibility for seat movement, and connects to a vertical standpipe 40. The standpipe 40, which can be either exposed or hidden within a wall cavity, leads to a vacuum pump 45 that creates a negative pressure to facilitate the air movement. The pressurized side of the vacuum pump 45 connects to a vent stack 50 that exits through the building envelope 55, ensuring proper ventilation. The system is activated by a pressure-activated switch 60 located under the seat surface 25, which turns on the vacuum pump 45 when a user sits down. The seat surface 25 includes a protective screen 65 for each suction port 30 to prevent solid and liquid wastes from entering. The entire system is powered by a power source 85, connected via wiring 90 to the vacuum pump motor 95, ensuring efficient operation whenever the seat surface 25 is occupied.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 4. The user would procure the odor removal device for toilets 10 from conventional procurement channels such as hardware stores, home improvement stores, mechanical supply houses, mail order and internet supply houses and the like. Special attention would be paid to the overall size and shape of the seat surface 25, such that it matches the toilet 15, the source of the power source 85, and the routing and location of the standpipe 40, and the vent stack 50.

After procurement and prior to utilization, the seat surface 25 would be installed upon the toilet 15 using the attachment feature of the hinges 20, the standpipe 40 would be routed internal or external to any wall structure, the vent stack 50 would be placed through the building envelope 55, the vacuum pump 45 would be installed between the standpipe 40 and the vent stack 50, and wiring 90 would be installed between the power source 85, the switch 60, and the vacuum pump motor 95. At this point in time, the device 10 is ready for use.

During utilization the user would ensure the seat surface 25 is in a down position as shown in FIG. 1. The user would sit upon the seat surface 25 and perform their bathroom duties in a conventional and transparent manner. During said sitting operation, the switch 60 would be closed, thus energizing the vacuum pump motor 95 from the power source 85. Said energization would result in a negative ambient pressure being generated in the vent stack 50, the flexible tube 35, and the hollow cavity 75 of the seat surface 25. This results in the removal of any malodorous air 70 from the toilet 15 which keeps the ambient air free from any foul odors.

After use of the device 10, the user stands up from the seat surface 25 in a normal and transparent manner, thus stopping operation of the vacuum pump 45 immediately, or after a predetermined time limit. This resets the operation of the device 10 for future use in a cyclical and repeating manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An odor removal device for a toilet, comprising:

a hollow seat surface configured to replace a conventional toilet seat and be mechanically coupled to the toilet via hinges, the hollow seat surface defining a continuous hollow interior cavity extending throughout a circumference of the seat surface to provide uniform airflow distribution;

a plurality of suction ports positioned on an inner circumferential edge of the seat surface and oriented to face downward toward a toilet bowl opening to draw malodorous air upward from within the toilet bowl;

a plurality of shrouds, each shroud individually covering a respective one of the suction ports and a protective screen associated therewith, each shroud forming a downward-opening air intake channel between the shroud and the inner circumferential edge of the seat surface, the downward-opening air intake channel directing airflow from the toilet bowl through the protective screen and into the suction port while shielding the suction port and protective screen from contamination by solids and liquids deposited on an upper surface of the seat;

a flexible tube connected to the hollow seat surface for transporting the malodorous air from the continuous hollow interior cavity to the standpipe;

a standpipe in mechanical communication with the flexible tube, the standpipe configured to be routed within a wall cavity adjacent to the toilet to route the malodorous air vertically;

a vacuum pump positioned at a top end of the standpipe and connected thereto, the vacuum pump creating a negative pressure that places the standpipe, the flexible tube, and the hollow seat surface simultaneously under negative pressure during operation to draw the malodorous air through the suction ports;

a vent stack connected to the vacuum pump and configured to pass through a building envelope to exhaust the malodorous air outside the building;

a pressure-activated switch located under the seat surface and configured to close and activate the vacuum pump when a user sits on the seat surface; and, a power source connected to the vacuum pump motor through electrical wiring that also connects the pressure-activated switch in a series circuit, such that the vacuum pump motor receives electrical power from the power source and operates only when the pressure-activated switch is closed.

2. The odor removal device of claim 1, further comprising:

a timer mechanism configured to allow the vacuum pump to continue operating for a predetermined period of time after the pressure-activated switch opens upon the user rising from the seat surface, thereby ensuring complete evacuation of residual malodorous air from the hollow interior cavity, the flexible tube, and the standpipe.

* * * * *